US010022635B2

(12) United States Patent
Goto et al.

(10) Patent No.: US 10,022,635 B2
(45) Date of Patent: Jul. 17, 2018

(54) ASSEMBLY PLAY EQUIPMENT FOR CHILDREN

(71) Applicant: Gototaiki Co., LTD., Oita (JP)

(72) Inventors: Yoshimasa Goto, Oita (JP); Hidebumi Goto, Kanagawa (JP)

(73) Assignee: GOTOTAIKI CO., LTD., Oita (JP)

( * ) Notice: Subject to any disclaimer, the term of this patent is extended or adjusted under 35 U.S.C. 154(b) by 0 days.

(21) Appl. No.: 15/307,558

(22) PCT Filed: Oct. 13, 2015

(86) PCT No.: PCT/JP2015/080045
§ 371 (c)(1),
(2) Date: Oct. 28, 2016

(87) PCT Pub. No.: WO2017/056335
PCT Pub. Date: Apr. 6, 2017

(65) Prior Publication Data

US 2017/0266571 A1 Sep. 21, 2017

(30) Foreign Application Priority Data

Oct. 3, 2015 (JP) ..... 2015-207543

(51) Int. Cl.
*A63G 21/02* (2006.01)
*A63G 31/00* (2006.01)

(52) U.S. Cl.
CPC ..... *A63G 31/00* (2013.01); *A63G 21/02* (2013.01)

(58) Field of Classification Search
CPC ..... A63G 21/00; A63H 33/06; A63H 33/08; A63B 9/00; A63B 2009/002;
(Continued)

(56) References Cited

U.S. PATENT DOCUMENTS 3,485,494 A * 12/1969 Lieberman ..... A63B 9/00 482/35
D219,603 S * 12/1970 Wormser ..... D21/826
(Continued)

FOREIGN PATENT DOCUMENTS

JP 924166 A 1/1997
JP 5728725 B1 6/2015

OTHER PUBLICATIONS

English Abstract for Japanese Publication No. 5728725 B1, published Jun. 3, 2015, 1 pg.
(Continued)

*Primary Examiner* — Loan H Thanh
*Assistant Examiner* — Gary D Urbiel Goldner
(74) *Attorney, Agent, or Firm* — Fredrickson & Byron, P.A.

(57) ABSTRACT

An assembly play equipment for children has bases comprising of a pair of end plates which are made vertical in shape and face each other, are formed at top parts of facing surfaces with open windows, are connected at center parts by a seat surface member, are connected at bottom parts by reinforcing members, and are provided at the center parts with pluralities of first connecting holes for connection use which form rotation preventing parts, and one or plural such bases have a step climbing stand, slide, twisted slope, climbing slope, arcade bridge, arch balustrade net bridge, corridor bridge, bulging bridge, wave bridge, or ring tunnel suitably selected and assembled together with the one or plural such bases by connecting the second connecting holes and the first connecting holes with connecting pieces.

1 Claim, 19 Drawing Sheets

(58) Field of Classification Search
CPC ..... A63B 2009/004; A63B 2009/006; A63B 17/00; A63B 17/02; A63B 17/04; A63B 26/00; A63B 26/003; A63B 71/0054; A63B 71/02; A63B 71/023; A63B 71/04; A63B 2071/0063; A63B 2071/0072; A63B 2071/0081; A63B 2071/009; A63B 2071/026; A63B 2071/027; A63B 2209/00; A63B 2209/02; A63B 2209/023; A63B 2210/50; A63B 2225/09; A63B 2225/093; A63B 2225/10; A63B 2244/12
See application file for complete search history.

(56) References Cited

U.S. PATENT DOCUMENTS 3,947,024 A * 3/1976 Slater ..... A63B 9/00 427/221
5,205,748 A * 4/1993 Petersheim ..... A63B 9/00 434/258
5,496,232 A * 3/1996 Morris ..... A63B 9/00 482/148
5,554,074 A * 9/1996 Von Parrish ..... A63B 9/00 472/116
5,711,253 A * 1/1998 Phillips ..... A01K 15/025 119/421
5,842,926 A * 12/1998 Rodriguez-Ferre .... A63G 21/00 472/116
D413,370 S * 8/1999 Kirn ..... D21/814
5,938,566 A * 8/1999 Rodriguez-Ferre ..... A63B 9/00 446/476
6,165,106 A * 12/2000 McBride ..... A63B 9/00 482/35
6,558,295 B2 * 5/2003 Araki ..... A63B 9/00 482/35
9,517,419 B1 * 12/2016 Lee ..... A63G 31/00
2006/0079379 A1 * 4/2006 Zeilinger ..... A63B 9/00 482/35
2007/0111631 A1 * 5/2007 Chen ..... A63G 31/00 446/124
2009/0197740 A1 * 8/2009 Julskjaer ..... A63B 9/00 482/35
2010/0304935 A1 * 12/2010 Todokoro ..... B25B 7/02 482/35
2012/0083350 A1 * 4/2012 Frankowski ..... A63G 31/00 472/128
2012/0157266 A1 * 6/2012 Todokoro ..... A63B 9/00 482/35
2012/0316038 A1 * 12/2012 Beckwith ..... A63G 31/00 482/35
2013/0178299 A1 * 7/2013 Kopp ..... A63G 9/00 472/136
2015/0157891 A1 * 6/2015 Mellott ..... A63B 9/00 472/136
2015/0335932 A1 * 11/2015 Chen ..... A63B 9/00 482/36

OTHER PUBLICATIONS

English Abstract for Japanese Publication No. JPH09-24166 A, published Jan. 28, 1997, 1 pg.
Untranslated Office Action and Notice of Reasons for Rejection mailed by Japan Patent Office (JPO) for Application No. JP 2016-017521, dated May 31, 2016, 3 pages.
English translation of Office Action and Notice of Reasons for Rejection mailed by Japan Patent Office (JPO) for Application No. JP 2016-017521, dated May 31, 2016, 3 pages.

* cited by examiner (1)

(2)

ASSEMBLY PLAY EQUIPMENT FOR CHILDREN

RELATED APPLICATIONS

This application is a 35 U.S.C. 371 national stage filing from International Application No. PCT/JP2015/080045, filed Oct. 13, 2015, which claims priority to Japanese Application No. 2015-207543, filed Oct. 3, 2015, the teachings of which are incorporated herein by reference.

TECHNICAL FIELD

The present invention relates to assembly play equipment for use of young children of one to three years age or so.

BACKGROUND ART

An assembly play equipment for children has to be designed and fabricated with ingenuity while giving first priority to safety.

On top of this, an assembly play equipment for children should be a wonderful present by which young children newly entering this world can be induced to make maximum use of their physical potential and can be encouraged to develop their interests, satisfy their curiosity, and foster their mental abilities and spirit of challenge in a natural manner through physical activity.

In the past, various playground equipment for young child use has been invented, but none of these realized the above concepts. The reason for this was that to broaden the age range of the young children covered to enable longer years of use, the playground equipment inevitably ended up focusing on older children of four to six years of age. For young children of less than that, their guardians had to stay by them to enable safe use. Specifically, devices for preventing falls, devices for preventing entry and exit from other than predetermined locations, and other safety and protective measures gave the equipment a closed nature and imperfect feel.

SUMMARY OF INVENTION

Technical Problem

However, if trying to install such safety and protective measures at the playground equipment, appearance-wise, the playground equipment tended to end up unattractive. The present invention provides an imaginative assembly play equipment for children which uses a small number of reconfigurable members to realize the above concepts and specifically satisfy the following conditions:

1) Safe structure while eliminating closed nature.

2) Sufficient ability to enable young children at play to be watched and the abilities etc. of the children to be observed 3) Design and structure enabling young children to freely engage in routine activities and engage in satisfactory playtime activities.

4) Design and structure enabling easy reconfiguration in accordance with the application in front of the eyes of the young children so as match the routine and playtime activities of the young children and fostering bold thinking, interests, mental abilities, and spirit of challenge in a natural manner through physical activity.

5) Ability through 4) for young children to reconfigure assembly play equipment on their own or change it to desired configuration

Solution to Problem

The features of the child-use assembly play equipment of the present invention which satisfies these requirements are as in the following (A) to (C).

(A) An assembly play equipment for children comprised of a base which is comprised of a pair of end plates which are made vertical in shape and face each other, are formed at top parts with open windows, are connected at center parts by a seat surface member, are connected at bottom parts by reinforcing members, and are provided with first connecting holes for connection use which form rotation preventing parts, at least one of a step climbing stand, bulging climbing stand, slide, climbing slope, and twisted slope which are provided with second connecting holes which are connected to the first connecting holes of the base by connecting pieces and which have rotation preventing parts, and at least one of an arcade bridge, arch balustrade net bridge, corridor bridge, wave bridge, ring tunnel, and bulging bridge which are provided with second connecting holes which are connected to the first connecting holes of the base by connecting pieces between bases, wherein each connecting piece is provided with a bolt which is formed at its back part with a flange which abuts against an entrance circumferential surface of a first connecting hole or second connecting hole, is formed at its flange with an insert connecting part which forms a rotation preventable part which is fit into the rotation preventing part of the first connecting hole or second connecting hole, and is formed with a male screw part at a part which sticks out from the first connecting hole or second connecting hole and is provided with a nut which is formed with a flange which abuts against an exit circumferential surface of the first connecting hole or the second connecting hole through a looseness preventing packing and is formed with a female screw part which screws over the male screw part of the bolt.

(B) An assembly play equipment for children which has a base which is comprised of a pair of end plates which are made vertical in shape and face each other, are formed at top parts of the facing surfaces with open windows, are connected at center parts by a seat surface member, are connected at bottom parts by reinforcing members, and are provided at the center parts at the two end parts with first connecting holes for connection use which form rotation preventing parts and which has first connecting holes of first end parts of the end plates of the base connected to second connecting holes of the following (1), (2), or (3) by connecting pieces and has other end parts of the end plates connected to second connecting holes of the following (3, (4), or (5) by connecting pieces:

(1) a step climbing stand which is provided at two sides of climbing steps with handrail-equipped holding frames and is provided at the top end parts of the handrail-equipped holding frames with second connecting holes for the connecting piece use and forming rotation preventing parts, (2) a bulging climbing stand which is provided at the two sides of a bulging climbing plate with handrail-equipped holding frames, is provided at the climbing plate with climbing assisting ropes, and is provided at the top end parts of the handrail-equipped holding frames with second connecting holes for the connecting piece use and forming rotation preventing parts, (3) a slide which is provided at the two sides of a slide plate with handrail-equipped holding frames and is provided at the top end parts of the handrail-equipped holding frames with second connecting holes for the connecting piece use and forming rotation preventing parts, (4) a twisted slope which is provided at the two sides of a slide plate with handrail-equipped holding frames, is provided at parts of the top end parts of the handrail-equipped holding frames with second connecting holes for the connecting piece use and forming rotation preventing parts, and has a twisted slide surface member arranged at the slide plate, and (5) a climbing slope which suitably arranges climbing projections at a slope plate, is provided at the two sides of the top part of the slope plate with handrail-equipped holding frames, is provided at the handrail-equipped holding frames with open windows, and is provided with second connecting holes which form rotation preventing parts, wherein each connecting piece is provided with a bolt which is formed at its back part with a flange which abuts against an entrance circumferential surface of a first connecting hole or second connecting hole, is formed at its flange with an insert connecting part which forms a rotation preventable part which is fit into the rotation preventing part of the first connecting hole or second connecting hole, and is formed with a male screw part at a part which sticks out from the first connecting hole or second connecting hole and is provided with a nut which is formed with a flange which abuts against an exit circumferential surface of the first connecting hole or the second connecting hole through a looseness preventing packing and is formed with a female screw part which screws over the male screw part of the bolt.

(C) An assembly play equipment for children which is comprised of a plurality of bases, each base comprised of a pair of end plates which are made vertical in shape and face each other, are formed at top parts of the facing surfaces with open windows, are connected at center parts by a seat surface member, are connected at bottom parts by reinforcing members, and are provided at the center parts at the two end parts with first connecting holes for connection use which form rotation preventing parts, wherein a base at an end part has at least one of the following connected to it by connecting pieces through the second connecting holes and the first connecting holes:

(1) a step climbing stand which is provided at two sides of climbing steps with handrail-equipped holding frames and is provided at the top end parts of the handrail-equipped holding frames with second connecting holes for the connecting piece use and forming rotation preventing parts, (2) a bulging climbing stand which is provided at the two sides of a bulging climbing plate with handrail-equipped holding frames, is provided at the climbing plate with climbing assisting ropes, and is provided at the top end parts of the handrail-equipped holding frames with second connecting holes for the connecting piece use and forming rotation preventing parts, (3) a slide which is provided at the two sides of a slide plate with handrail-equipped holding frames and is provided at the top end parts of the handrail-equipped holding frames with second connecting holes for the connecting piece use and forming rotation preventing parts, (4) a twisted slope which is provided at the two sides of a slide plate with handrail-equipped holding frames, is provided at parts of the top end parts of the handrail-equipped holding frames with second connecting holes for the connecting piece use and forming rotation preventing parts, and has a twisted slide surface member arranged at the slide plate, and (5) a climbing slope which suitably arranges climbing projections at a slope plate, is provided at the two sides of the top part of the slope plate with handrail-equipped holding frames, is provided at the handrail-equipped holding frames with open windows, and is provided with second connecting holes which form rotation preventing parts, wherein the bases between them have at least one of the following connected to them by connecting pieces through the second connecting holes and the first connecting holes:

(6) an arcade bridge which is provided at the two sides of a crossing member with handrail-equipped holding frames which are formed with open windows, has attached to it a transparent arcade which surrounds the two sides and top of a young child passing between the handrail-equipped holding frames, and is provided at the two end parts at the front and back of the handrail-equipped holding frames with second connecting holes for the connecting piece use and forming rotation preventing parts, (7) an arch balustrade net bridge which is provided at the two sides of a net member with holding frames which are curved outward, has arch shaped balustrades comprised of horizontal members and vertical members assembled together attached to the holding frames, is provided at the two end parts at the front and back of the holding frames with support members, and is provided at the support members with second connecting holes for the connecting piece use and forming rotation preventing parts, (8) a corridor bridge which is provided at the two sides of a curved crossing corridor bridge with holding side walls which are formed with open windows and is provided at the two end parts at the front and back of the holding side walls with second connecting holes for the connecting piece use and forming rotation preventing parts, (9) a bulging bridge which is provided at the two sides of a bulging crossing plate with holding arch walls which are formed with open windows and is provided at the two end parts at the front and back of the holding arch walls with second connecting holes for the connecting piece use and forming rotation preventing parts,

(10) a wave bridge which is provided at the two sides of a wave crossing plate with holding arch walls provided with open windows and with open windows over which transparent plates are attached and preventing falls, is provided at an entrance and exit of the holding arch walls with support arches, and is provided at the bottom end parts of the holding arch walls with second connecting holes for the connecting piece use and forming rotation preventing parts, and

(11) a ring tunnel which is provided with a plurality of oval rings and a net which surround a bottom part, two side parts, and upper part of a curved crossing plate and arch members which support these through horizontal bars and are arranged at the entrance and exit and support members at the bottom part of the arch members, at the support members, second connecting holes for the connecting piece use and forming rotation preventing parts being provided, and wherein each connecting piece is provided with a bolt which is formed at its back part with a flange which abuts against an entrance circumferential surface of a first connecting hole or second connecting hole, is formed at its flange with an insert connecting part which forms a rotation preventable part which is fit into the rotation preventing part of the first connecting hole or second connecting hole, and is formed with a male screw part at a part which which sticks out from the first connecting hole or second connecting hole and is provided with a nut which is formed with a flange which abuts against an exit circumferential surface of the first connecting hole or the second connecting hole through a looseness preventing packing and is formed with a female screw part which screws over the male screw part of the bolt.

Advantageous Effects of Invention

The assembly play equipment for children of the present invention is comprised of one or more bases of a design encouraging climbing and the freely selected wonderfully designed open-feeling parts of (1) to (8). All of the parts which are connected to the bases have at least entrances and exits of the crossing passages matched in level with the levels of the seat surfaces of the end plates. Connecting piece are used to quickly, easily, and ruggedly connect the parts, so there are no inside barriers to movement. The sight of the children at play can be enjoyed and the abilities of the children etc. can be clearly observed. An athletic playground equipment of a safe, imaginative, fun, 3D design can be configured. Due to this, the assembly play equipment for children of the present invention can draw out from young children a feeling of wanting to play upon seeing the set. Further, it is possible to see friends at play from inside and outside the playground equipment. Also, children at play can be watched to check their reflexes and ensure safety. Further, the children can not only enjoy the sight of the assembly play equipment, but can also freely touch it, ride on it or shake it and slide on it, so there are the superior action and effect of enabling learning through experience and learning through application via the medium of curiosity and challenge.

The pair of end plates of the base are made plates with flat front and back surfaces and with the entire end faces between the front and back surfaces preferably made curved to give them roundness and thereby enable ruggedness and safe handling with little restraint. Further, the edge parts of the two plate surfaces are provided with pluralities of first connecting holes which the connecting pieces are used to fasten so as to hold the shape, so the end plates will never detach during use, will never loosen, and will never deform, so safety is ensured. Furthermore, it is possible to systematically assemble the parts to draw out the interest of the young children and stimulate their sense of challenge and motor reflexes etc. The number of variations used is multiplied.

The connecting pieces can be used to connect the bases and the above parts in any freely selected number. They safely fasten and connect the parts and hold those states in the face of all sorts of rough handling by young children. Further, the parts can be easily attached and detached by the later explained simple structure wrench SP etc.

The main configurable structures are given in the following examples, but these are just partial examples. There are many variations. The creative energies of the children can be harnessed to design various sets and the sets can be assembled in front of them. This plays an important role as educational material.

BRIEF DESCRIPTION OF DRAWINGS

FIG. 1-2 gives a perspective explanatory view (1) which shows Example of Base 2 of assembly parts of the assembly play equipment for children of the present invention, while (2) is a side view of an end plate.

FIG. 1-3 gives a perspective explanatory view (1) which shows Example of Base 3 of assembly parts of the assembly play equipment for children of the present invention, while (2) is a side view of an end plate.

FIG. 1-4 gives a perspective explanatory view (1) which shows Modified Example of Base 4 of the base which is shown in FIG. 1-1 of assembly parts of the assembly play equipment for children of the present invention FIG. 1-5 gives a perspective explanatory view which shows Modified Example of Base 5 of the base which is shown in FIG. 1-2 of assembly parts of the assembly play equipment for children of the present invention FIG. 1-6 gives a perspective explanatory view which shows Modified Example of Base 6 of the base which is shown in FIG. 1-3 of assembly parts of the assembly play equipment for children of the present invention.

FIG. 2 gives a perspective explanatory view (1) which shows an example of a step climbing stand of assembly parts of the assembly play equipment for children of the present invention, while (2) is a side view of a step climbing stand.

FIG. 3 gives a perspective explanatory view which shows an example of a bulging climbing stand of assembly parts of the assembly play equipment for children of the present invention.

FIG. 4 gives a perspective explanatory view (1) which shows an example of a slide of assembly parts of the assembly play equipment for children of the present invention, while (2) is a side view of a slide.

DESCRIPTION OF EMBODIMENTS

Embodiments of the present invention will be explained in detail by the following examples.

EXAMPLES

Figure 1:
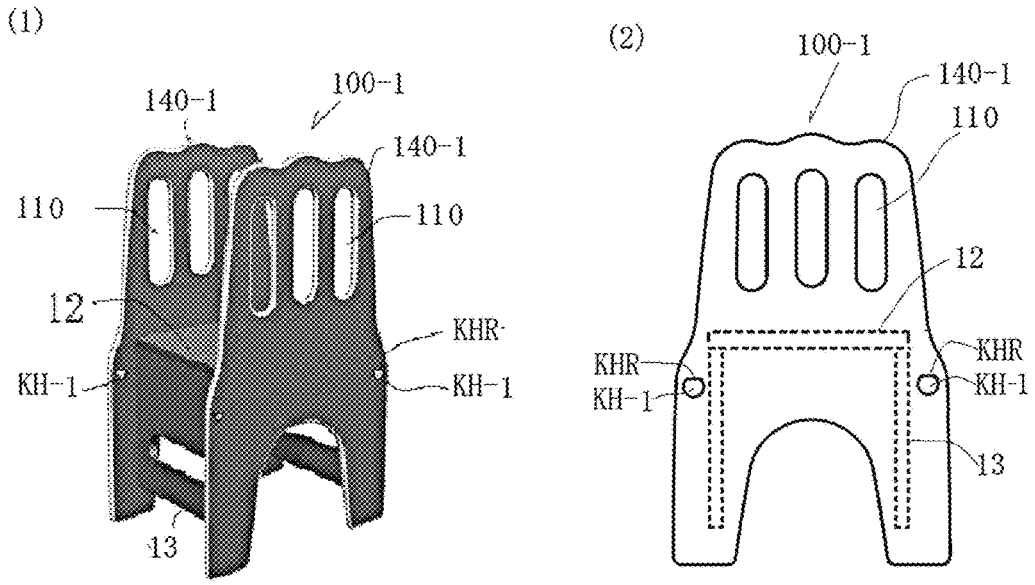
FIG. 1-1 gives a perspective explanatory view (1) which shows Example of Base 1 of assembly parts of the assembly play equipment for children of the present invention, while (2) is a side view of an end plate.
Figures 1, 2:
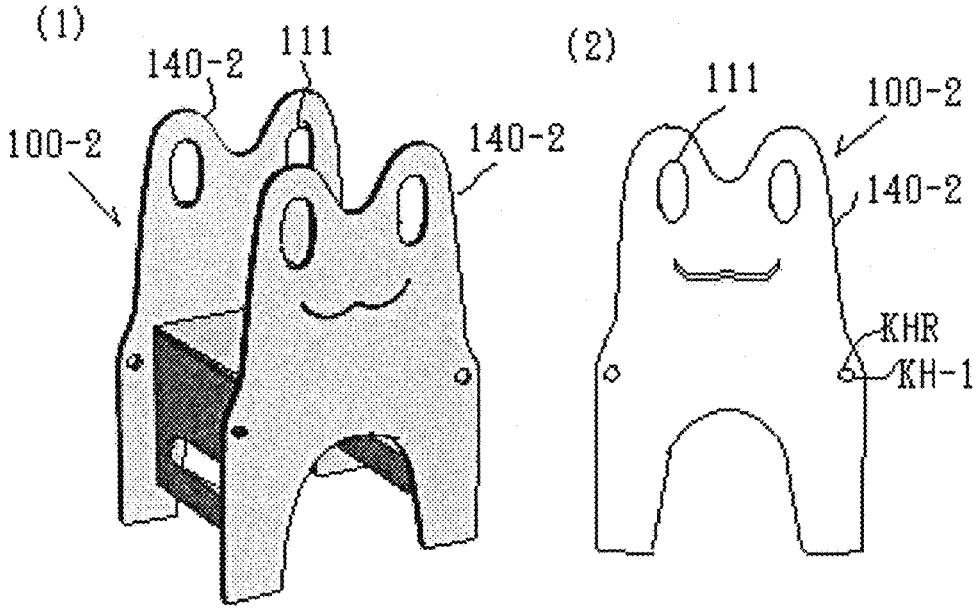
Figures 1, 2, 3:
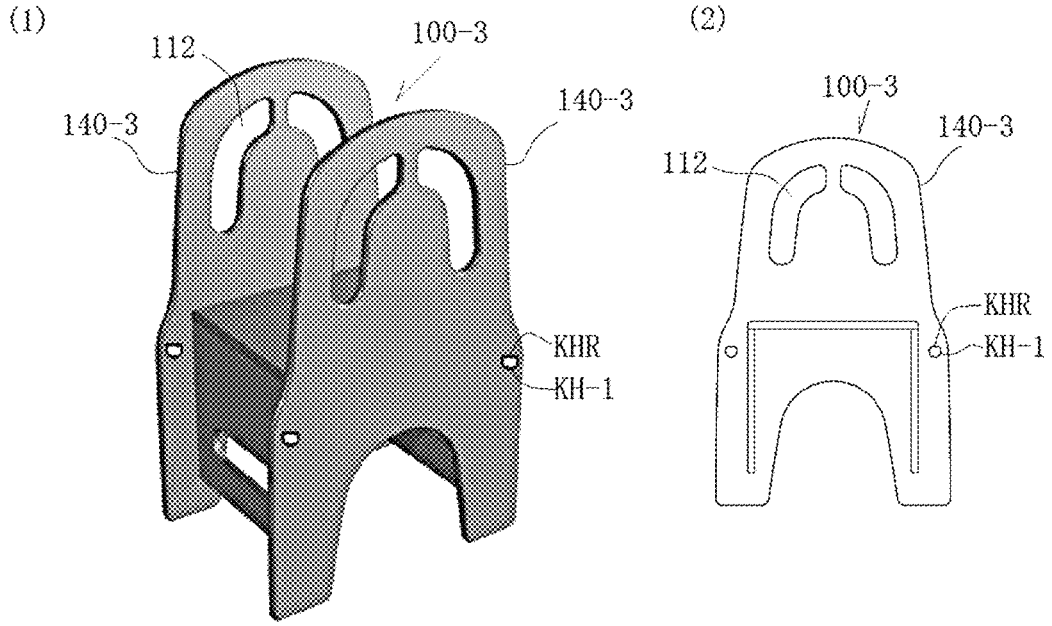
Figures 1, 2, 3, 4:
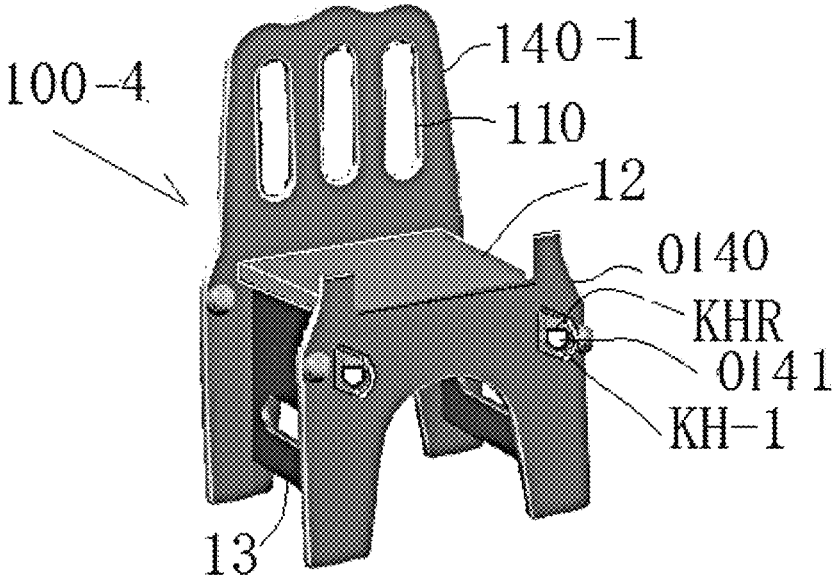
Figures 1, 2, 3, 4, 5:
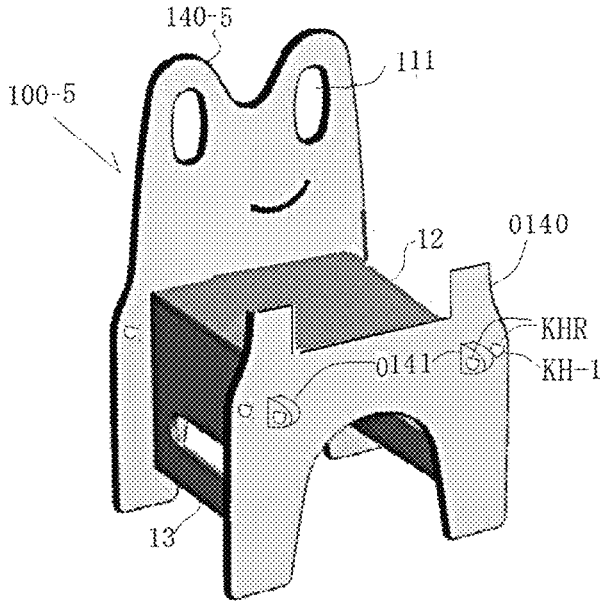
Figures 1, 2, 3, 4, 5, 6:
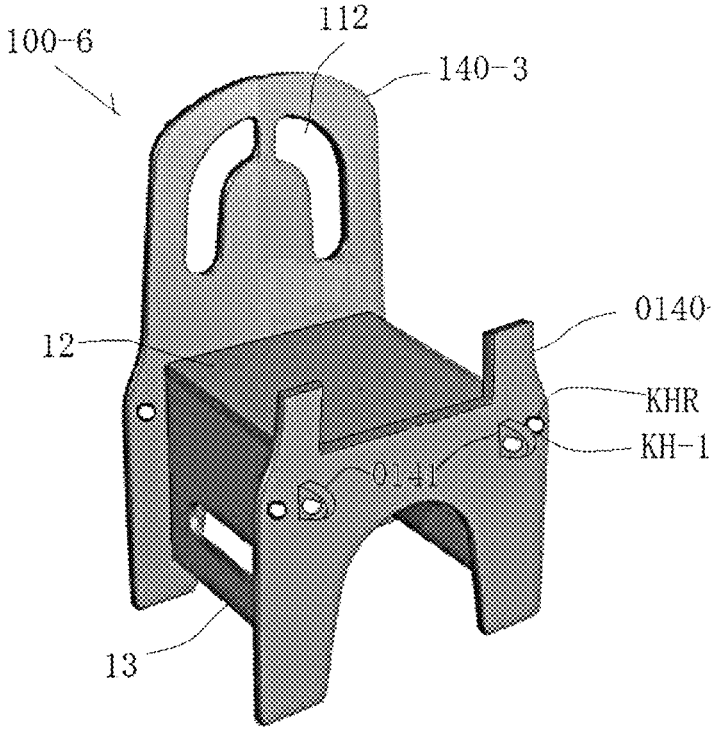
Figure 2:
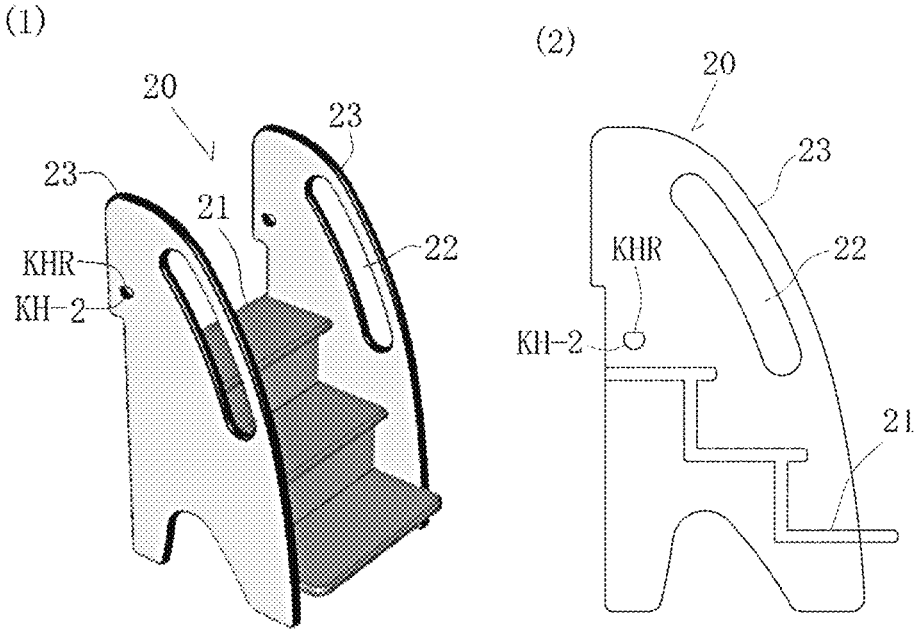
Figure 3:
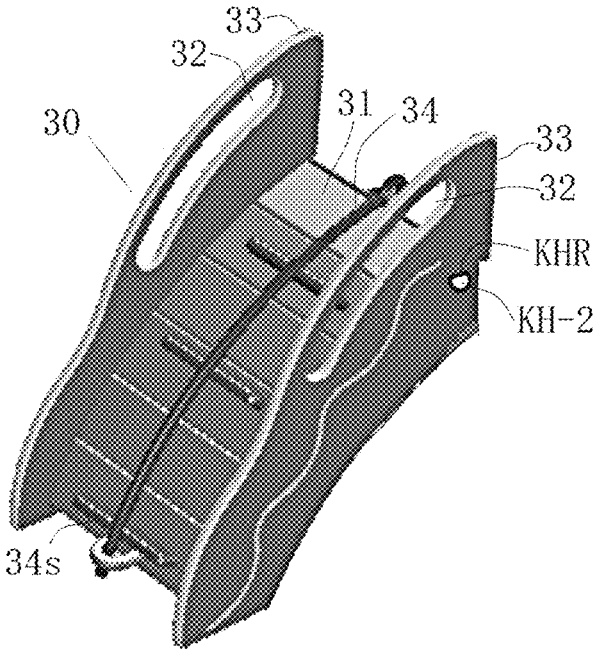
Figure 4:
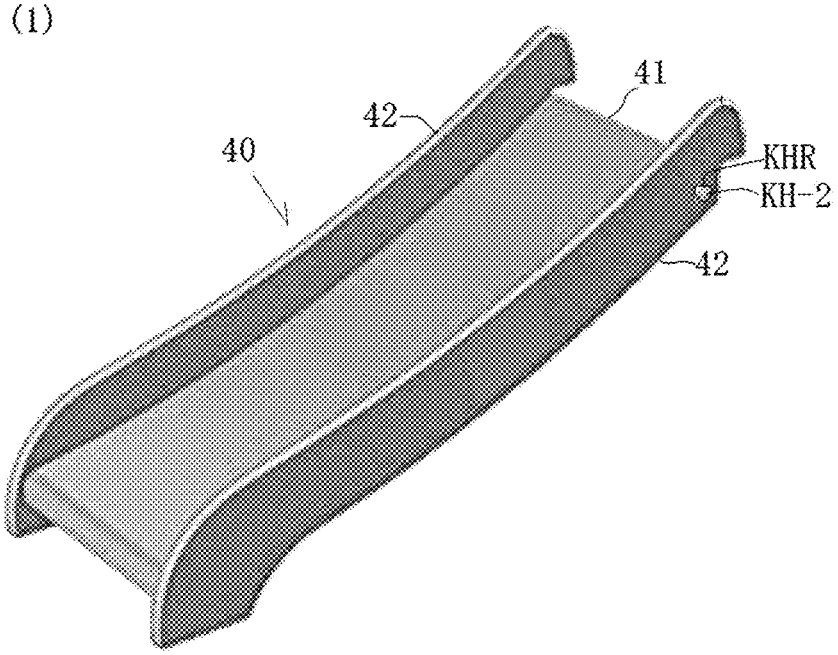
Figure 4:
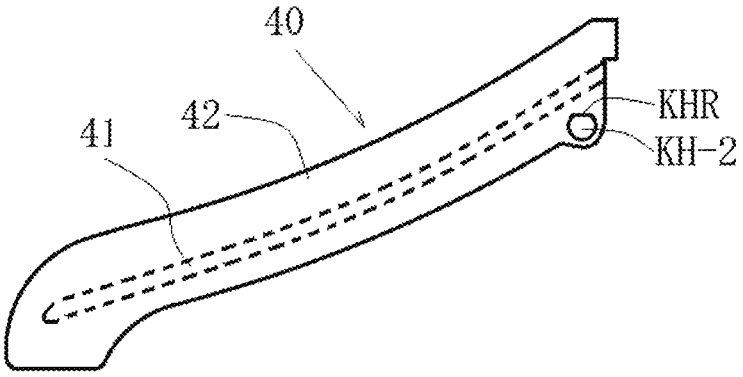
Figure 5:
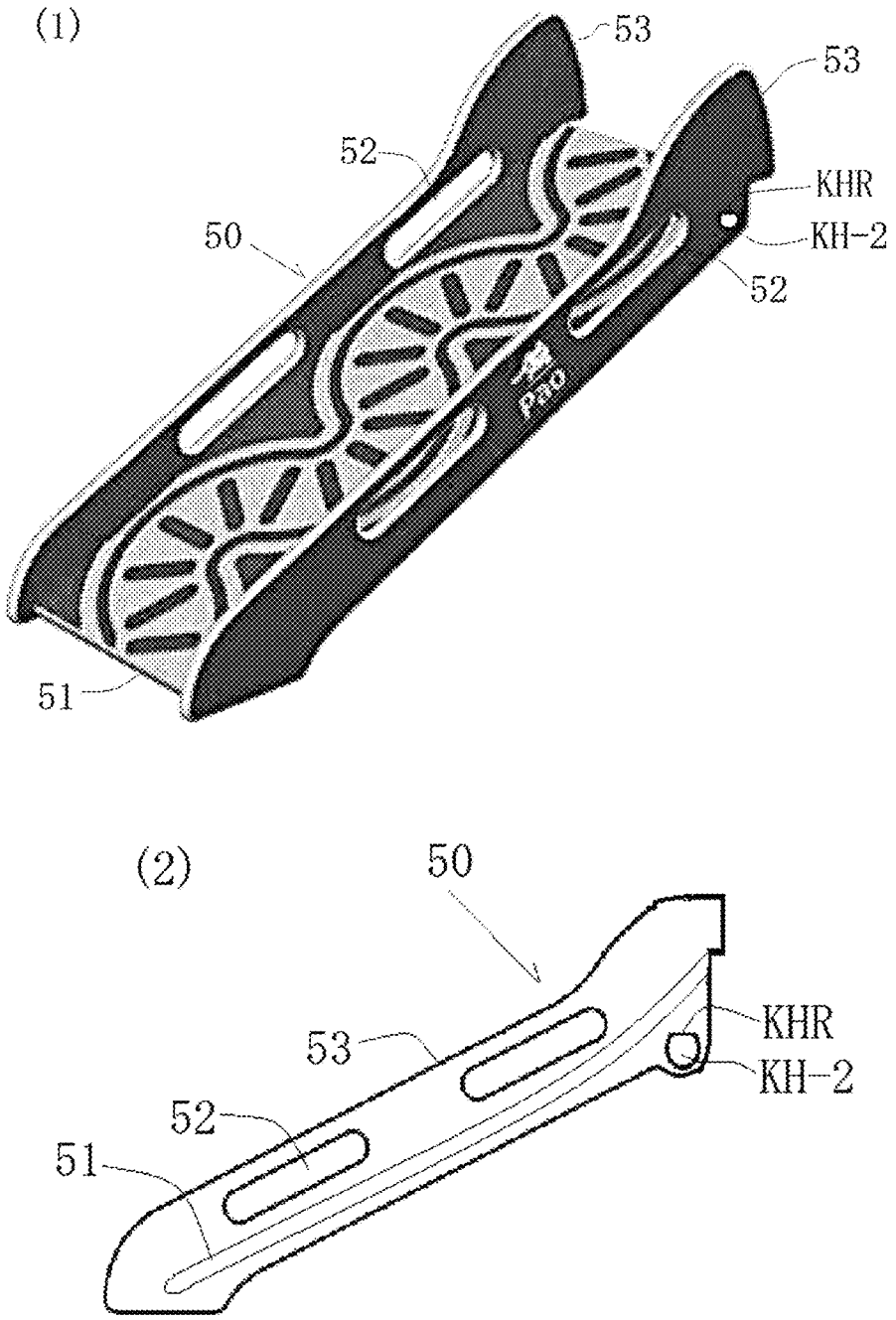
FIG. 5 gives a perspective explanatory view (1) which shows an example of a twisted slope of assembly parts of the assembly play equipment for children of the present invention, while (2) is a side view of a twisted slope.
Figure 6:
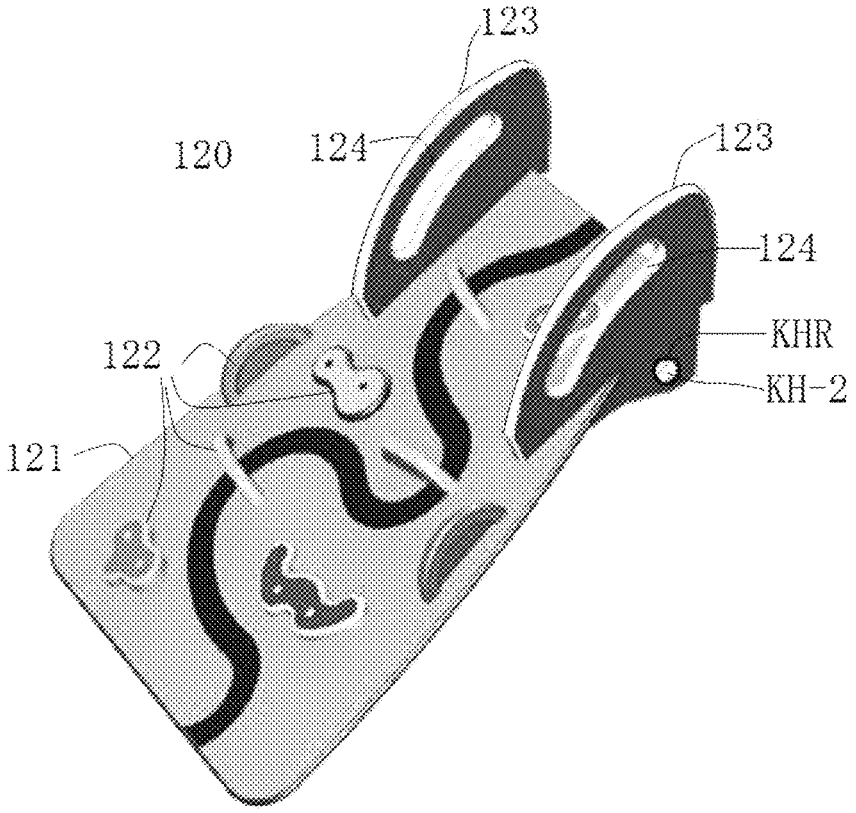
FIG. 6 gives a perspective explanatory view which shows an example of a climbing slope of assembly parts of the assembly play equipment for children of the present invention.
Figure 7:
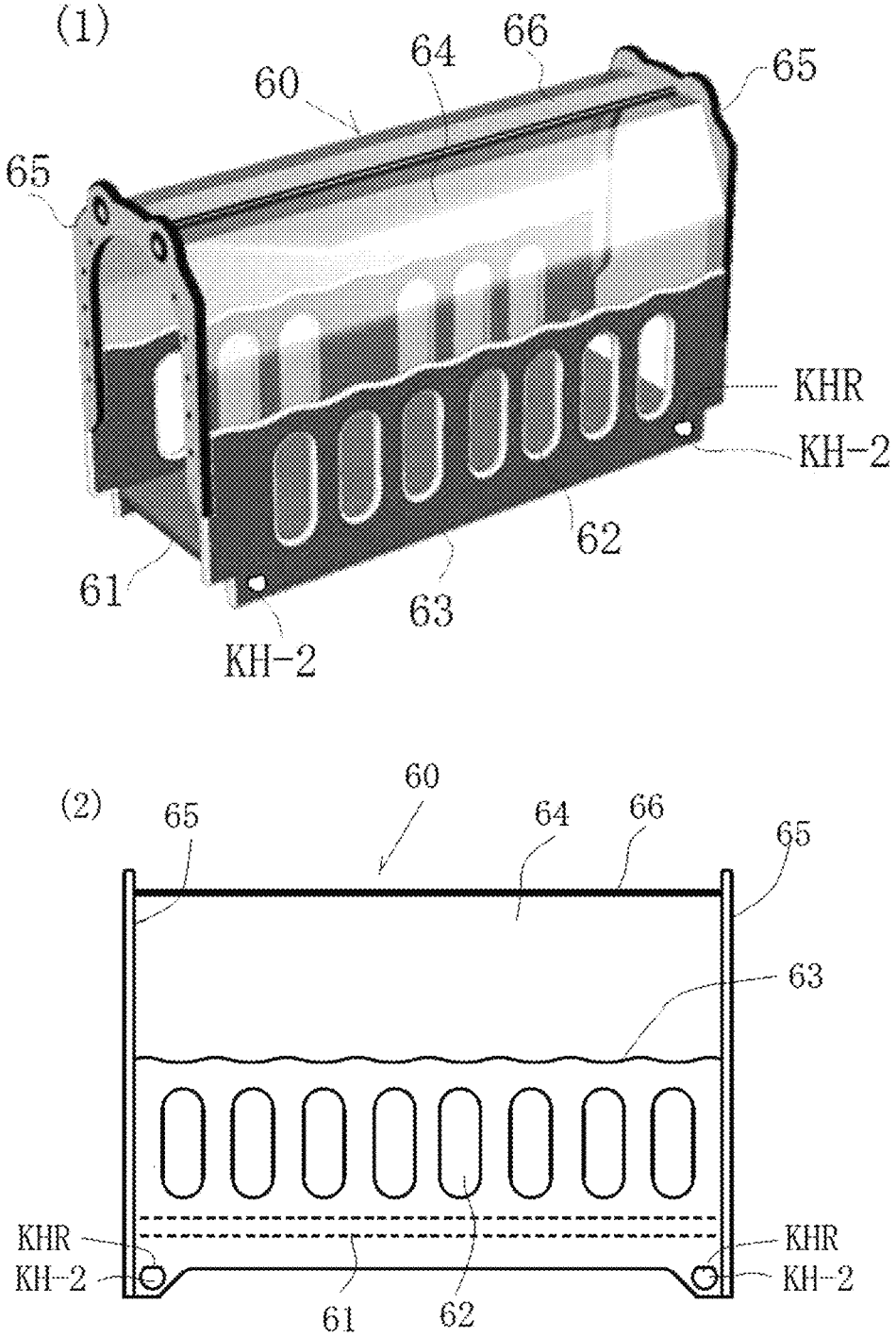
FIG. 7 gives a perspective explanatory view (1) which shows an example of an arcade crossing bridge (=plastic tunnel) of assembly parts of the assembly play equipment for children of the present invention, while (2) is a side view of a plastic tunnel.
Figure 8:
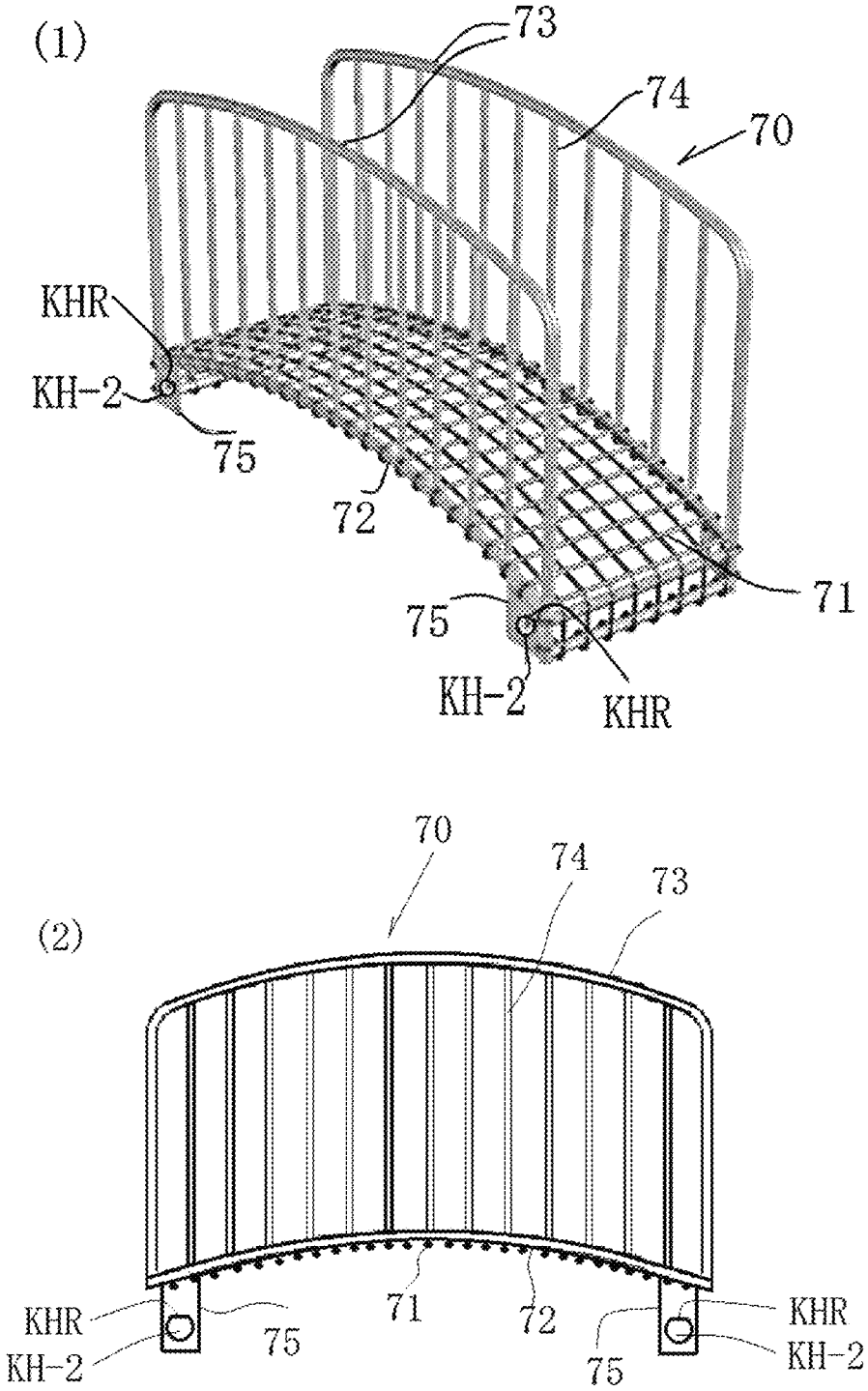
FIG. 8 gives a perspective explanatory view which shows an example of an arch balustrade net bridge of assembly parts of the assembly play equipment for children of the present invention, while (2) is a side view of an example of an arch balustrade net bridge.
Figure 9:
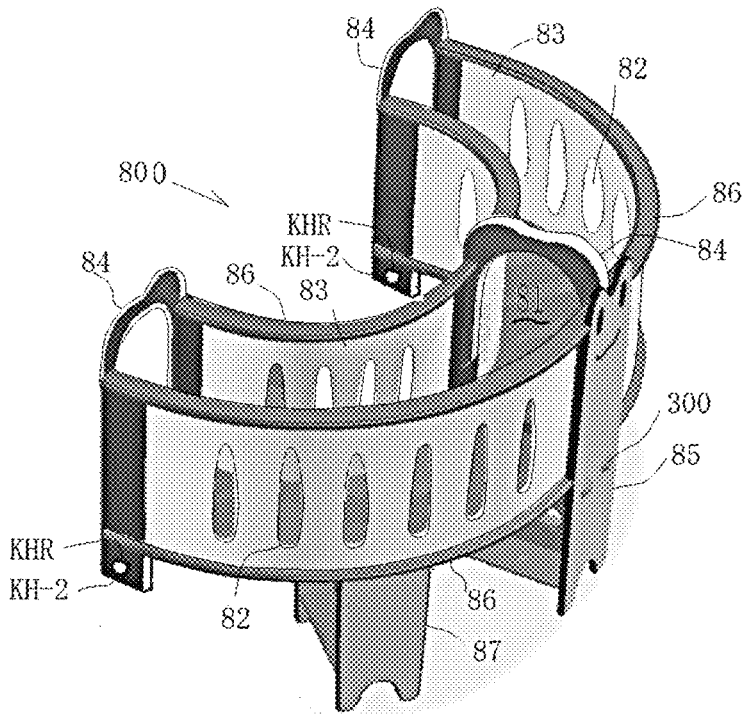
FIG. 9 gives a perspective explanatory view which shows a corridor bridge shown in FIG. 22 of assembly parts of the assembly play equipment for children of the present invention.
Figure 10:
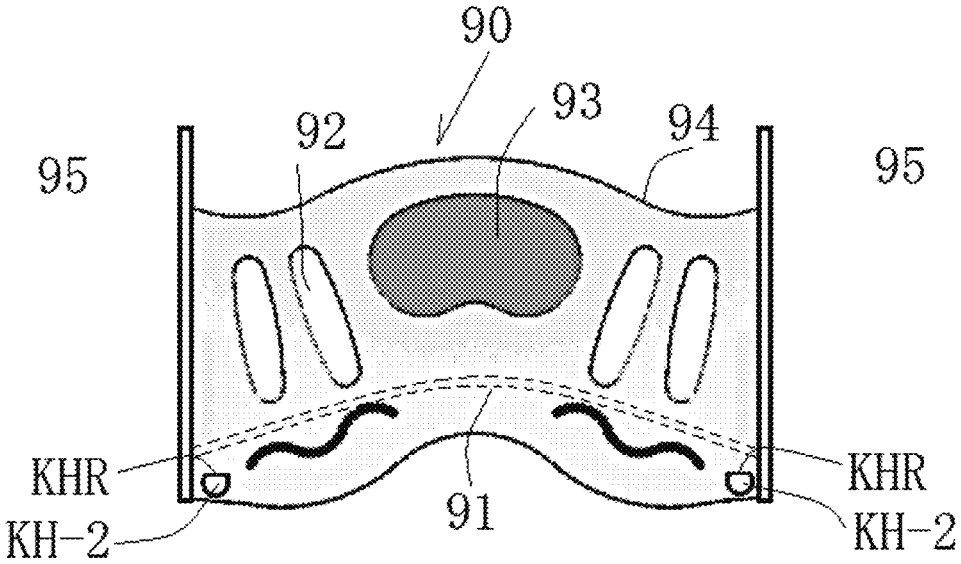
FIG. 10 gives a side view which shows an example of a bulging bridge of assembly parts of the assembly play equipment for children of the present invention.
Figure 11:
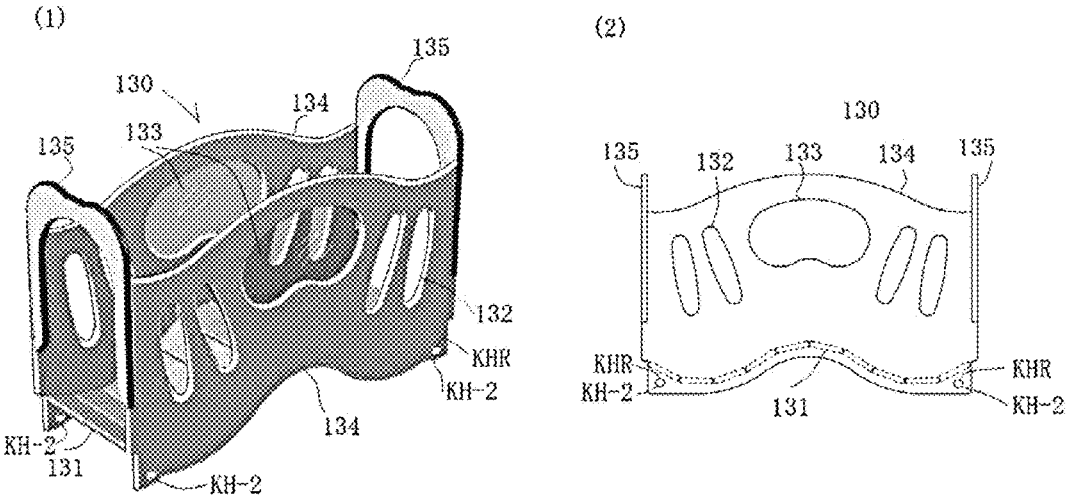
FIG. 11 gives a perspective explanatory view (1) which shows one example of a wave bridge of assembly parts of the assembly play equipment for children of the present invention, while (2) is a side view of a wave bridge.
Figure 12:
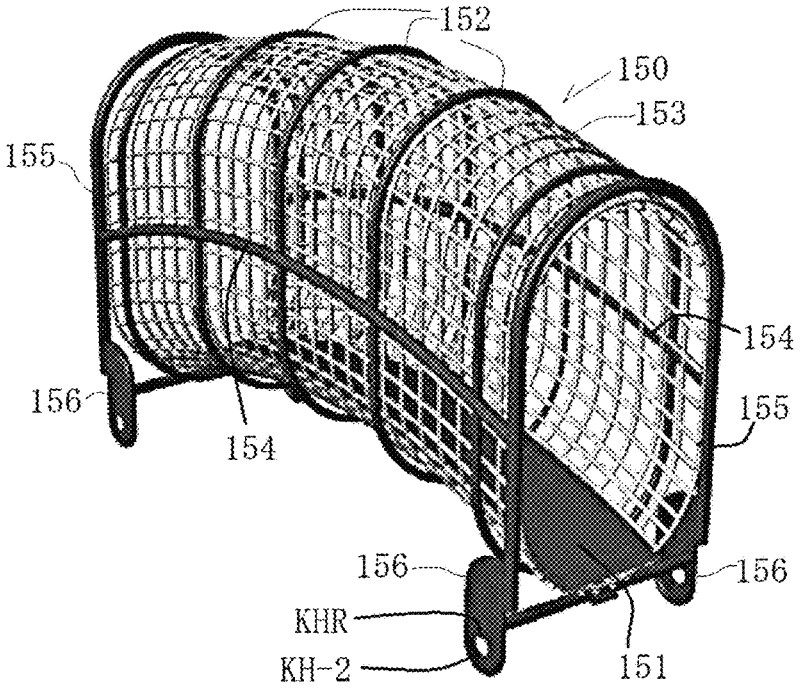
FIG. 12 gives a perspective explanatory view which shows an example of ring tunnel of assembly parts of the assembly play equipment for children of the present invention.
Figure 13:
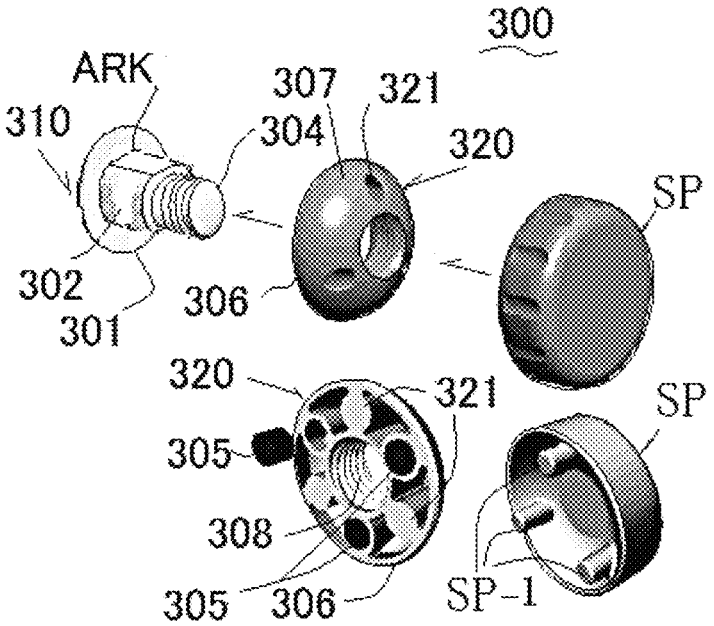
FIG. 13 gives an explanatory view which shows an example of a connecting piece for the assembly kit of the present invention.
Figure 17:
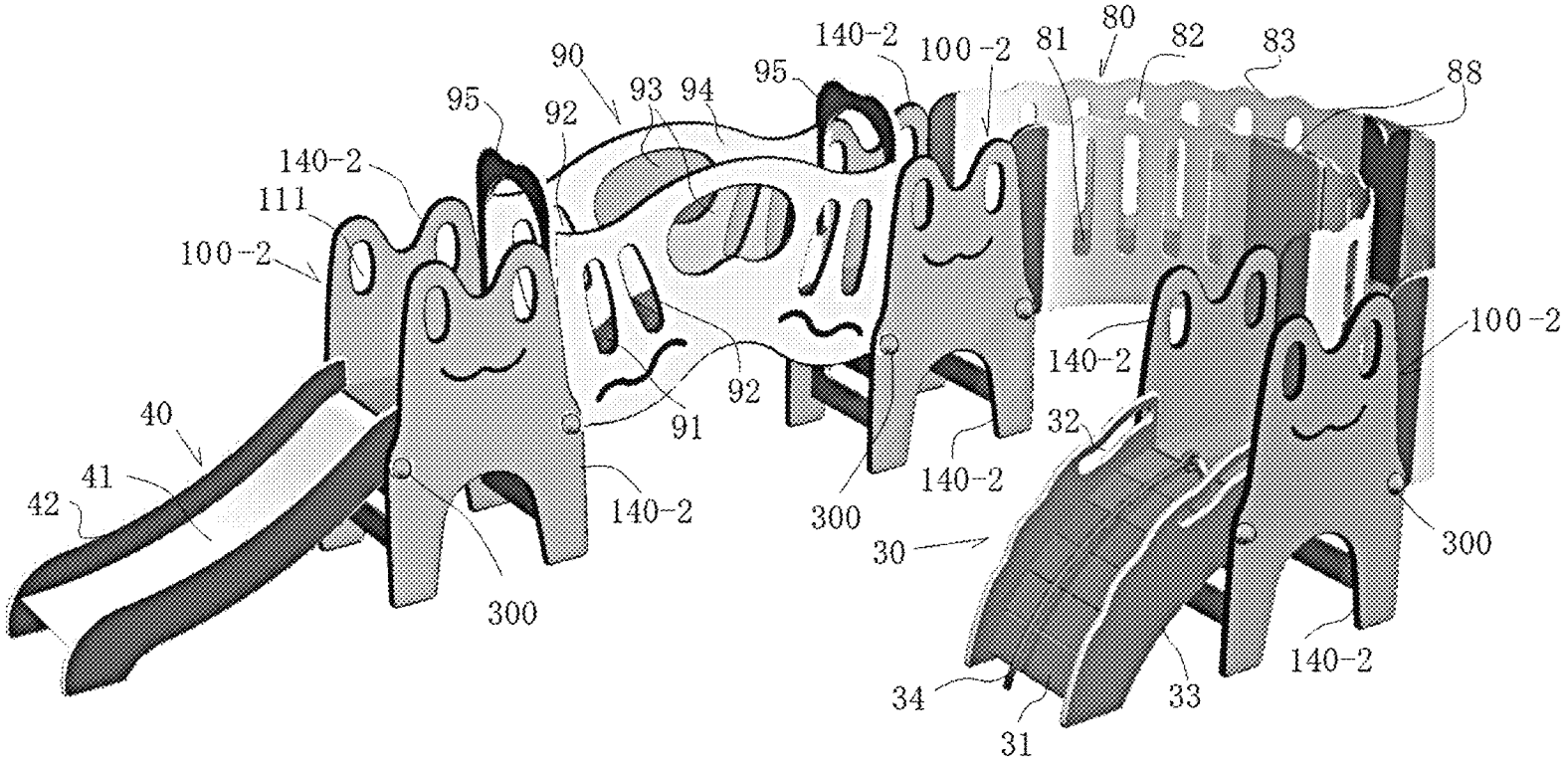
FIG. 17 gives a perspective explanatory view which shows an Example of Configuration 4.
Figure 18:
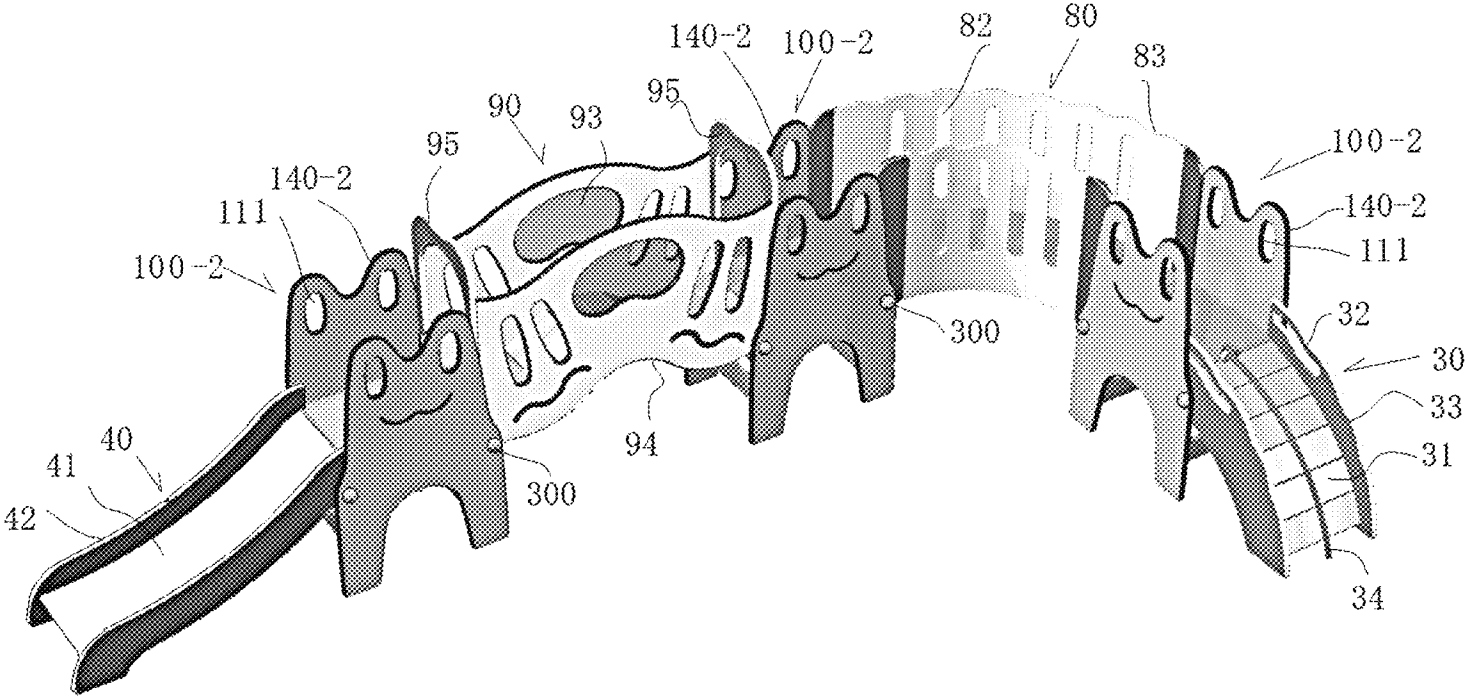
FIG. 18 gives a perspective explanatory view which shows an Example of Configuration 5.

FIG. 1 to FIG. 12 introduce the assembly parts of the assembly play equipment for children of embodiments of the present invention. These are suitably assembled by the connecting pieces 300 which are shown in FIG. 13. Fun examples of playground equipment obtained by the assembly play equipment are shown in FIG. 14 to FIG. 22. Examples of the parts of the assembly play equipment for children of these embodiments include the bases 100-1 to 100-6 which are shown in FIG. 1-1 to FIG. 1-6, the step climbing stand 20 which is shown in FIG. 2, the bulging climbing stand 30 which is shown in FIG. 3, the slide 40 which is shown in FIG. 4, the twisted slope 50 which is shown in FIG. 5, the climbing slope 120 which is shown in FIG. 6, the arcade bridge 60 which is shown in FIG. 7, the arch balustrade net bridge 70 which is shown in FIG. 8, the corridor bridge 80 which is shown in FIG. 17 and FIG. 18, the corridor bridge 800 which is shown in FIG. 9 and FIG. 22, the bulging bridge 90 which is shown in FIG. 10, the wave bridge 130 which is shown in FIG. 11, and the ring tunnel 150 which is shown in FIG. 12.

The base 100-1 which is shown in FIG. 1-1 is comprised of a pair of H-shaped end plates 140-1 which are made vertical in shape and face each other, are formed at the top parts of the facing surfaces with vertical oblong open windows 110 for preventing falling and enabling children at play to be watched from the inside and outside, are connected at the center parts by a seat surface member 12, and are connected at the bottom parts by reinforcing members 13. The end plates 140-1 are formed at the center parts at the front and back with pluralities of first connecting holes KH-1 for connection use and for forming rotation preventing parts KHR resulting in a rugged structure able to be safely handled without restraint.

Further, the end plates 140-1 are rounded at the entire end faces. Light weight, sturdy plywood comprised of various child-friendly colored boards combined together so that the end faces present layers of color, made of various color solid wood, made of plastic, made of light metals, etc. are used. At the side surfaces, pictures of animals, pictures of scenery, geometric patterns, cartoons, and other fun pictures are drawn to foster the color sense and visual sense of the children.

The base 100-2 which is shown in FIG. 1-2 is a type which employs H-shaped end plates 140-2 which are formed with vertical oblong open windows 111 at the top parts of the two sides. The other component members are the same as the base 100-1 which is shown in FIG. 1-1, so the same reference notations will be given and explanations will be omitted.

The base 100-3 which is shown in FIG. 1-3 is a type which employs arch-type end plates 140-3 which are formed with arch shaped or split arch shaped open windows 112 at the top parts. The other component members are the same as the base 100-1 which is shown in FIG. 1-1, so the same reference notations will be given and explanations will be omitted.

The base 100-4 which is shown in FIG. 1-4 is a modification of the base 100-1 which is shown in FIG. 1-1. One of the end plates is made the end plate 140-1, while the other is made a modified end plate 0140 with no top part. At the two side parts of the center part of the side surface, connection-use projections 0141 are provided. These connection-use projections 0141 are provided with the first connecting holes KH-1 and enable suitable parts to be connected to the base 100-4 in the horizontal direction.

The base 100-5 which is shown in FIG. 1-5 is a modification of the base 100-2 which is shown in FIG. 1-2. One of the end plates is made the end plate 140-2, while the other is made a modified end plate 0140 with no top part. At the two side parts of the center part of the side surface, connection-use projections 0141 are provided. These connection-use projections 0141 are provided with the first connecting holes KH-1 and enable suitable parts to be connected to the base 100-5 in the horizontal direction.

The base 100-5 which is shown in FIG. 1-6 is a modification of the base 100-3 which is shown in FIG. 1-3. One of the end plates is made the end plate 140-3, while the other is made a modified end plate 0140 with no top part. At the two side parts of the center part of the side surface, connection-use projections 0141 are provided. These connection-use projections 0141 are provided with the first connecting holes KH-1 and enable suitable parts to be connected to the base 100-5 in the horizontal direction.

The step climbing stand 20 which is shown in FIG. 2 is provided at the two sides of climbing steps 21 with handrail-equipped holding frames 23 with oblong open windows 22 and for preventing falling. At the top end parts of the handrail-equipped holding frames 23, second connecting holes KH-2 for the connecting piece 300 use and forming rotation preventing parts KHR are provided.

The bulging climbing stand 30 which is shown in FIG. 3 is provided at the two sides of a climbing bulging plate 31 with handrail-equipped holding frames 33 with oblong open windows 32 and for preventing falling. At the center of the climbing bulging plate 31, a climbing rope 34 is connected and hung down. It is supported by a rope 34*s*. At the top end parts of the handrail-equipped holding frames 33, second connecting holes KH-2 for the connecting piece 300 use and forming rotation preventing parts KHR are provided. The top end of the climbing bulging plate 31 is matched in level with the seat surface of the seat surface member 12 of the base to be connected so as to eliminate inside barriers to movement.

The slide 40 which is shown in FIG. 4 is provided at the two sides of a slide plate 41 with handrail-equipped holding frames 42 for preventing falling and is provided at the top end parts of the handrail-equipped holding frames 42 with second connecting holes KH-2 for the connecting piece 300 use and forming rotation preventing parts KHR. The handrail-equipped holding frames 42 may also be formed with open windows. Further, the top end of the slide plate 41 is matched in level with the seat surface of the seat surface member 12 of the base to be connected so as to eliminate inside barriers to movement.

The twisted slope 50 which is shown in FIG. 5 is provided at the two sides of a slide plate 51 with handrail-equipped holding frames 53 with oblong open windows 52 and for preventing falling, is provided at the bottom parts of the two sides of the top end parts of the handrail-equipped holding frames 53 with second connecting holes NR-2 for the connecting piece 300 use and forming rotation preventing parts KHR, and arranges on the slide plate 51 a twisted slope surface member 510. The open windows 52 enable young children in the process of sliding to be seen and are formed into oblong shapes along the sliding direction to prevent the hands of the young children etc. from being caught in them. The top end of the slide plate 51 is matched in level with the seat surface of the seat surface member 12 of the base to be connected so as to eliminate inside barriers to movement.

The climbing slope 120 which is shown in FIG. 6 suitably arranges climbing projections 122 at a slope plate 121, is provided at the two sides of the top part of the slope plate 121 with handrail-equipped holding frames 123, is provided at the handrail-equipped holding frames 123 with open windows 124, and is provided with second connecting holes KH-2 which form rotation preventing parts KHR.

The arcade bridge 60 which is shown in FIG. 7 is a bridge where children at play can be seen from the inside and outside. It is provided at the two sides of a crossing member 61 with handrail-equipped holding frames 63 which are provided with a large number of vertical oblong open windows 62, has attached to it a transparent arcade 64 which surrounds the two sides and top of a young child crossing between the handrail-equipped holding frames 63, is provided with support arches 65 at the entrance and exit of the arcade 64, is provided with support beams 66 which connect and support the top parts of the support arches 65 and hold the arcade 64, and is provided at the two end parts at the front and back of the handrail-equipped holding frames 63 with second connecting holes KH-2 for the connecting piece 300 use and forming rotation preventing parts KHR. The entrance and exit of the crossing member 61 are matched in level with the seat surface of the seat surface member 12 of the base to be connected so as to eliminate inside barriers to movement.

The arch balustrade net bridge 70 which is shown in FIG. 8 is a bridge where children at play can be seen from the inside and outside. It is provided, supporting the two sides of a net crossing member 71, with horizontal holding frames 72 which are curved outward, has attached on the horizontal holding frames 72 vertical members 73 in arch shapes at equal intervals to form balustrades 74, is provided at the two end parts at the front and back of the horizontal holding frames 72 with connecting members 75, and is provided at the connecting members 75 with second connecting holes KH-2 for the connecting piece 300 use and forming rotation preventing parts KHR. The entrance and exit of the net crossing member 71 are matched in level with the seat surface of the seat surface member 12 of the base to be connected so as to eliminate inside barriers to movement.

Each of the corridor bridge 800 which is shown in FIG. 9 and the corridor bridge 80 which is shown in FIG. 17 and FIG. 18 is formed at the two sides of a curved crossing corridor bridge 81 with open windows 82, is provided at the entrance and exit at two sides of the curved crossing corridor bridge 81 and an intermediate part with reinforcing arch members 84, is provided with holding side walls 83 which are suitably supported over their spans by support columns 85, support stands 87, etc., and are provided at the two end parts at the front and back of the holding side walls 83 with second connecting holes KH-2 for the connecting piece use and forming rotation preventing parts KHR. At the top and bottom of the holding side walls 83, reinforcing frames 86 are attached. The entrance and exit of the curved crossing corridor bridge 81 are matched in level with the seat surface of the seat surface member 12 of the base to be connected so as to eliminate inside barriers to movement. The corridor bridge 80 which is shown in FIG. 17 and FIG. 18 is formed at the two sides of the curved crossing corridor bridge 81 with open windows 82, is provided with holding side walls 83 suitably supported by connecting support columns 88 over their spans, and is provided at the two end parts at the front and back of the holding side walls 83 with not shown second connecting holes for the connecting piece use and forming rotation preventing parts.

The bulging bridge 90 which is shown in FIG. 10 is a bridge where children at play can be seen from the inside and outside. It is provided at the two sides of a bulging crossing plate 91 with holding arch walls 94 which are formed with open windows 92 which pass straight through them and open windows 93 which have transparent plates attached to them, is provided at the entrance and exit at the front and back of the holding arch walls 94 with arches 95, and is provided at the bottom parts of the two end parts with second connecting holes KH-2 for the connecting piece 300 use and forming rotation preventing parts KHR. The entrance and exit of the bulging crossing plate 91 are matched in level with the seat surface of the seat surface member 12 of the base to be connected so as to eliminate inside barriers to movement.

The wave bridge 130 which is shown in FIG. 11 is a bridge where children at play can be seen from the inside and outside. It is provided at the two sides of a wave crossing plate 131 with holding arch walls 134 provided with oblong open windows 132 and with open windows 133 over which transparent plates are attached and preventing falls, is provided at an entrance and exit of the holding arch walls 134 with support arches 135, and is provided at the bottom end parts of the holding arch walls with second connecting holes KH-2 for the connecting piece 300 use and forming rotation preventing parts KHR. The entrance and exit of the wave crossing plate 131 are matched in level with the seat surface of the seat surface member 12 of the base to be connected so as to eliminate inside barriers to movement.

The ring tunnel 150 which is shown in FIG. 12 is a bridge where children at play can be seen from the inside and outside. It is provided with a plurality of oval rings 152 and a net 153 which surround the bottom part, two side parts, and upper part of a curved crossing plate 151, arch members 155 which support these through horizontal bars 154 and are arranged at the entrance and exit, and support members 156 at the bottom part of the arch members 155. At the support members 156, second connecting holes KH-2 for the connecting piece 300 use and forming rotation preventing parts KHR are provided.

The connecting piece 300 which is shown in FIG. 13 is formed from light weight, rugged wood, plastic, light metal, etc. and can strongly connect any first connecting holes KH-1 which are provided at the bases 10, 100 and second connecting holes KH-2 which are provided at the climbing stand 20, bulging climbing stand 30, slide 40, twisted slope 50, arcade bridge 60, arch balustrade net bridge 70, corridor bridge 80, bulging bridge 90, etc. without distortion or looseness.

This connecting piece 300 is structured provided with a bolt 310 which is formed at its back part with a flange 301 which abuts against an entrance circumferential surface of a first connecting hole KH-1 or second connecting hole KH-2, is formed at its flange 301 with an insert connecting part 302 which forms a rotation preventable part ARK which is fit into the rotation preventing part KHR of the first connecting hole KH-1 or second connecting hole KH-2, and is formed with a male screw part 304 at a part which sticks out from the second connecting hole KH-2 after the insert connecting part 302 and is provided with a cap-shaped nut 320 which is formed with a cap 307 with a flange 306 which abuts against an exit circumferential surface of the second connecting hole KH-2 through a looseness preventing packing 305 and is formed with a female screw part 308 which screws over the male screw part 304 of the bolt 310.

The looseness preventing packing 305 of the nut 320 absorbs any external force which is applied at the time of being held with the flange 306 and after being held due to a cushion effect so the end plates 13 and the connection-use projections 15 are never crushed. This nut 320 is provided with a hole 321 for insertion of the projection SP-1 of the circular wrench SP and enables use of the wrench SP for rotation to fasten and loosen it.

Example of Configuration 1

Figure 14:
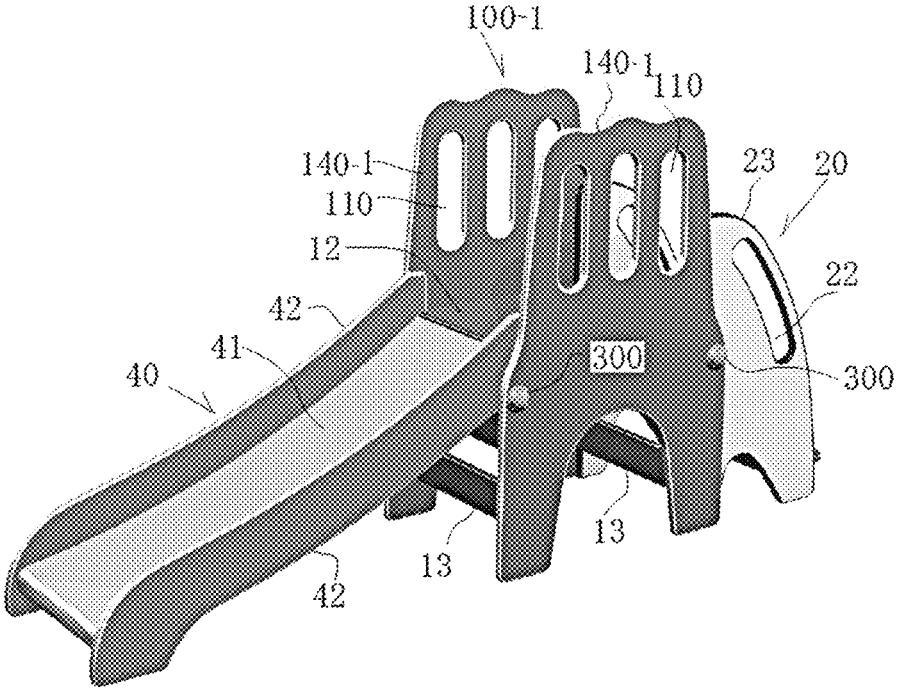
FIG. 14 gives a perspective explanatory view which shows an Example of Configuration 1.

Example of Configuration 1 which is shown in FIG. 14 is an example of configuration of a base 100-1, a climbing stand 20, and a slide 40. The example in FIG. 14 is an Example of Configuration 1 which is obtained by connecting to first connecting holes KH-1 at the center parts of the front parts of the end plates 140-1 of the base 100-1 the second connecting holes KH-2 of the top part of the slide 40 provided with the handrail-equipped holding frames by using the connecting pieces 300 and by connecting to the first connecting holes KH-1 of the center parts of the back parts of the end plates 140-1 the second connecting holes KH-2 of the top part of the climbing stand 20 by using the connecting pieces 300.

Example of Configuration 2

Figure 15:
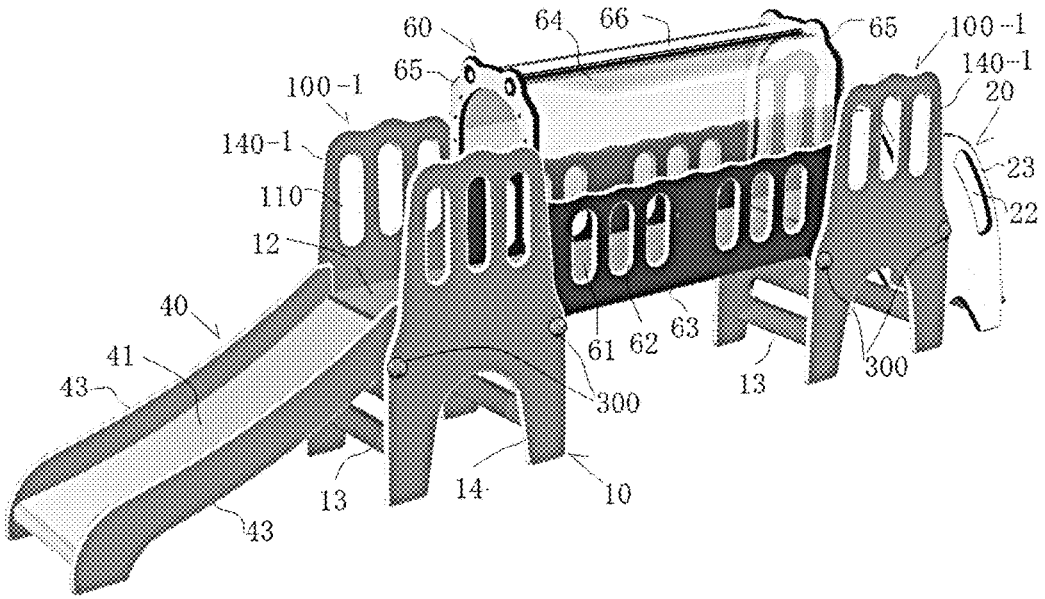
FIG. 15 gives a perspective explanatory view which shows an Example of Configuration 2.

Example of Configuration 2 which is shown in FIG. 15 is an example of configuration of two bases 100-1 to which the step climbing stand 20, slide 40, and arcade bridge 60 have been added. The example which is shown in FIG. 15 is an example which is obtained by preparing two bases 100-1, connecting to the first connecting holes KH-1 of the center parts of the front parts of the end plates 140-1 of the first base 100-1 the second connecting holes KH-2 of the top parts of the handrail-equipped holding frames 43 of the slide 40 by the connecting pieces 300, connecting to the first connecting holes KH-1 of the center parts of the back parts of the end plates 140-1 of the second base 100-1 the second connecting holes KH-2 of the top parts of the handrail-equipped holding frames 23 of the step climbing stand 20 by the connecting pieces 300, and assembling the arcade bridge 60 between the first base 100-1 and the first base 100-1.

Example of Configuration 3

Figure 16:
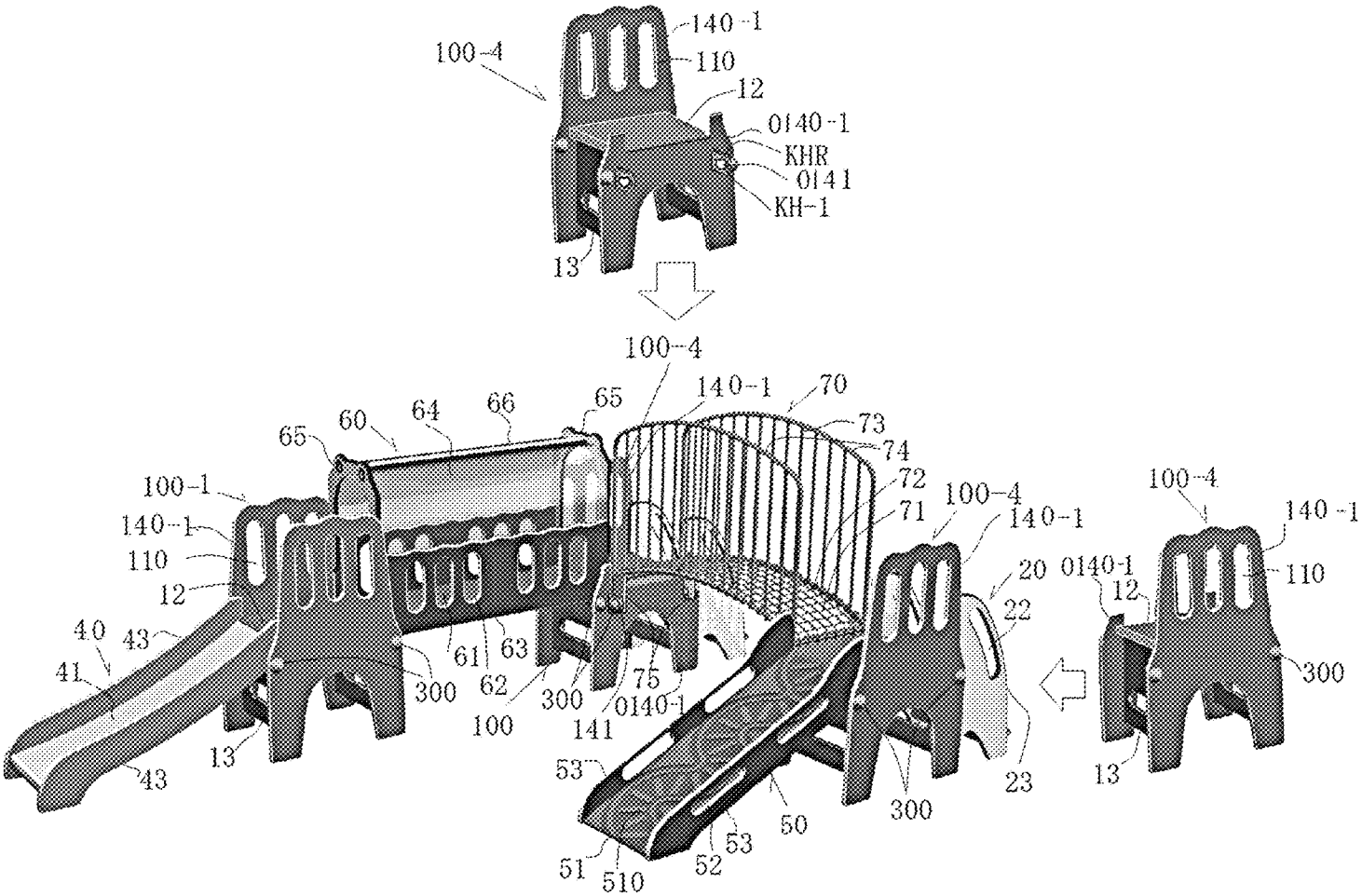
FIG. 16 gives a perspective explanatory view which shows an Example of Configuration 3.

Example of Configuration 3 which is shown in FIG. 16 is an example which is obtained by preparing three bases 100-1, 100-4, 100-4, connecting the slide 40 to the front parts of the end plates 140-1 of the first base 100-1, connecting an arcade bridge 60 between the first base 100-1 and the second base 100-4, connecting an arcade bridge 60 between the second base 100-4 and the third base 100-4, connecting step climbing stands 20 to the back part of the second base 100-4 and the back part of the third base 100-4, and connecting a twisted slope 50 to the front part of the third base 100-4.

Example of Configuration 4

Example of Configuration 4 which is shown in FIG. 17 is an example which is comprised of three bases 100-2, a slide 40, a step climbing stand 20, a bulging bridge 90, a corridor bridge 80, and a bulging climbing stand 30. That is, it is an example of a slide 40, a first base 100-2, a bulging bridge 90, a second base 100-2, a step climbing stand 20, a corridor bridge 80, a third base 100-2, and a bulging climbing stand 30 connected in that order. The present example is a type which mainly enables access to the playground equipment from the bulging climbing stand 30 and step climbing stand 20 and allows exit to the outside of the playground equipment from the slide 40.

Example of Configuration 5

Example of Configuration 5 which is shown in FIG. 18 is a modification of Example of Configuration 4 and an example in which a modified corridor bridge comprised of half of the corridor bridge 80 which is shown in Example of Configuration 4 is assembled.

Example of Configuration 6

Figure 19:
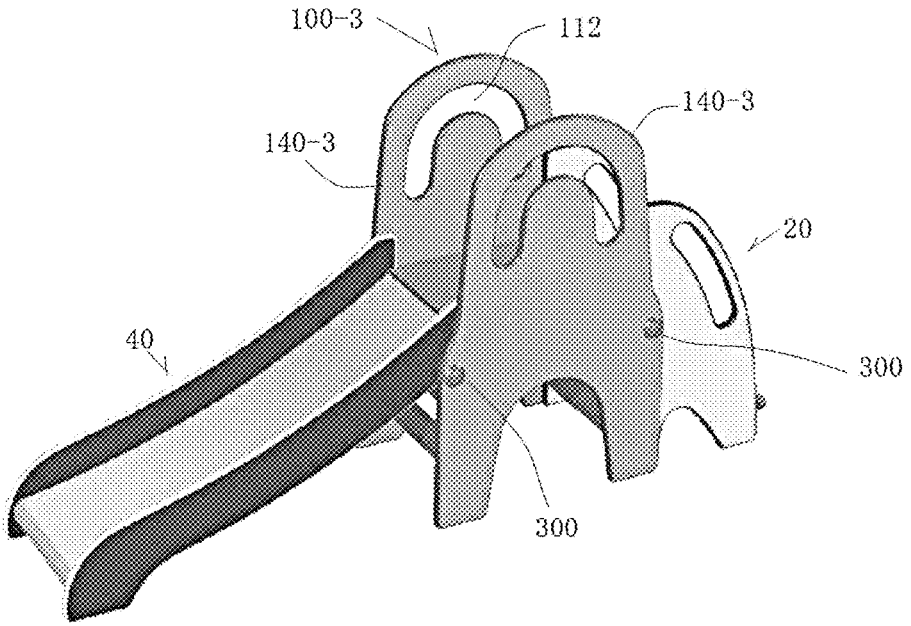
FIG. 19 gives a perspective explanatory view which shows an Example of Configuration 6.

Example of Configuration 6 which is shown in FIG. 19 is an example of configuration of a base 10-3, a step climbing stand 20, and a slide 40. The base 10-3, compared with the example which is shown in FIG. 1-3, has open windows 112 which are made arch shaped.

Example of Configuration 7

Figure 20:
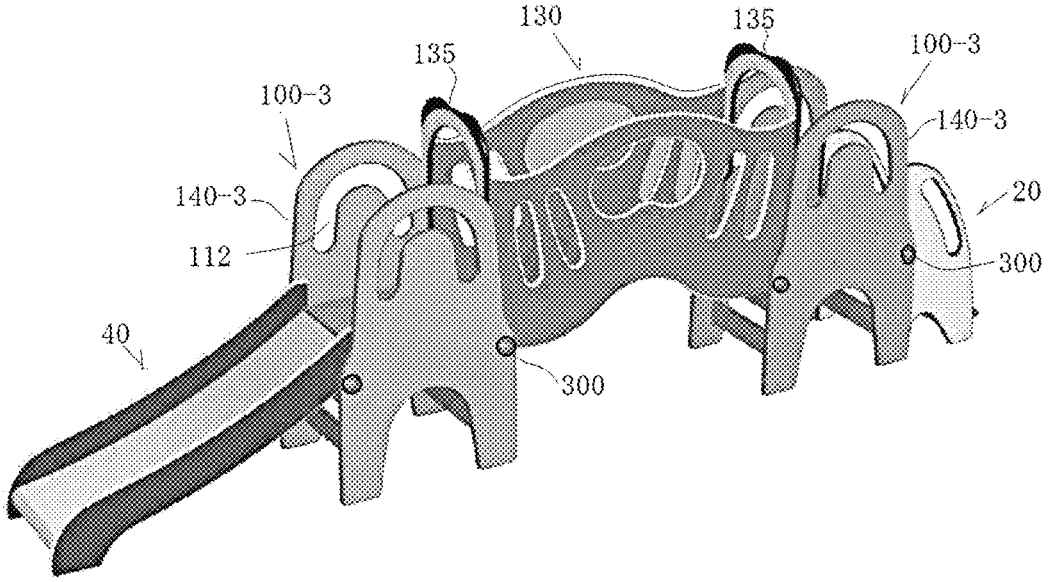
FIG. 20 gives a perspective explanatory view which shows an Example of Configuration 7.

Example of Configuration 7 which is shown in FIG. 20 is an example of configuration of a slide 40, a base 100-3, a wave bridge 130, a base 100-3, and a step climbing stand 20 in that order.

Example of Configuration 8

Figure 21:
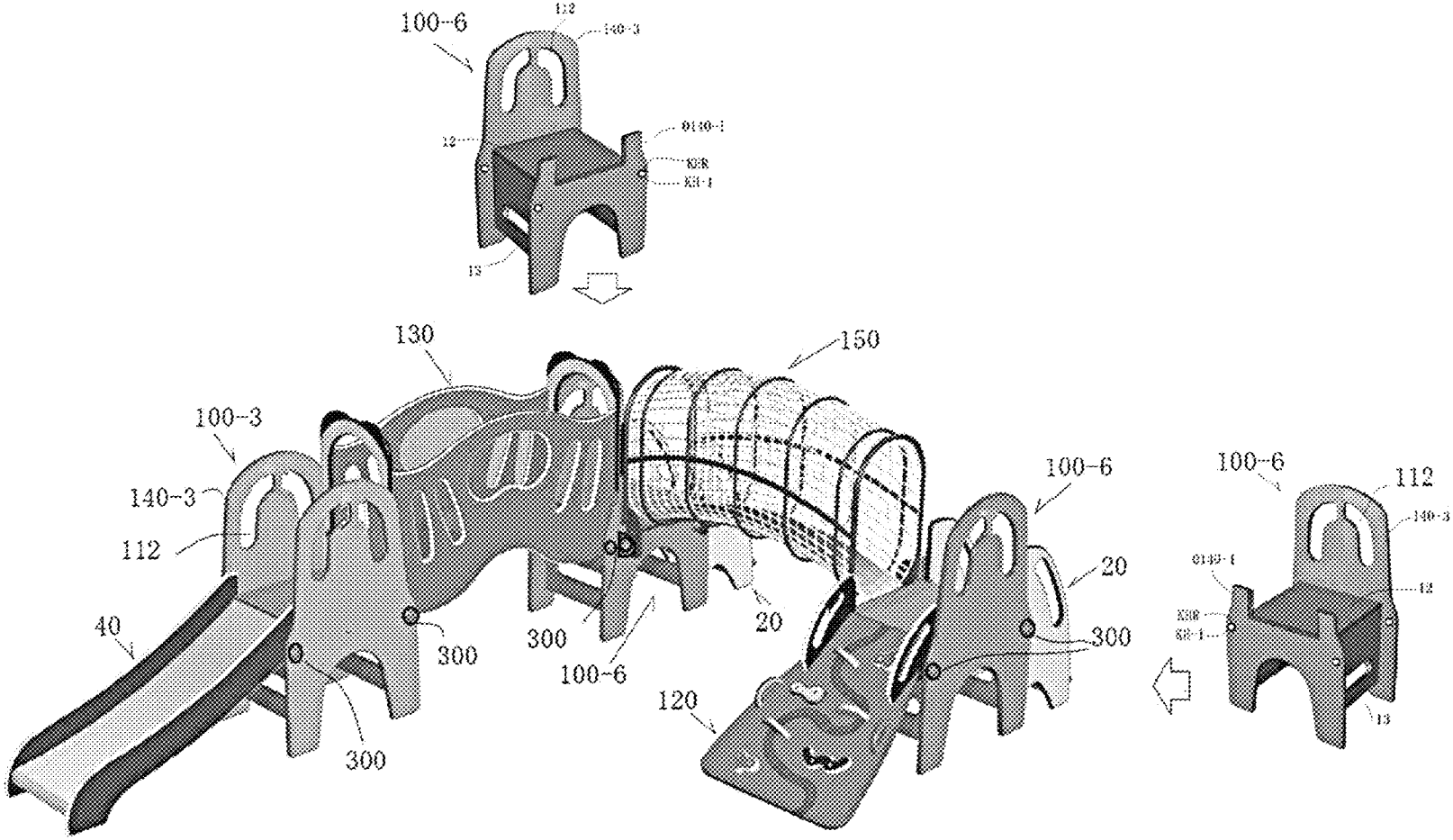
FIG. 21 gives a perspective explanatory view which shows an Example of Configuration 8.
Figure 22:
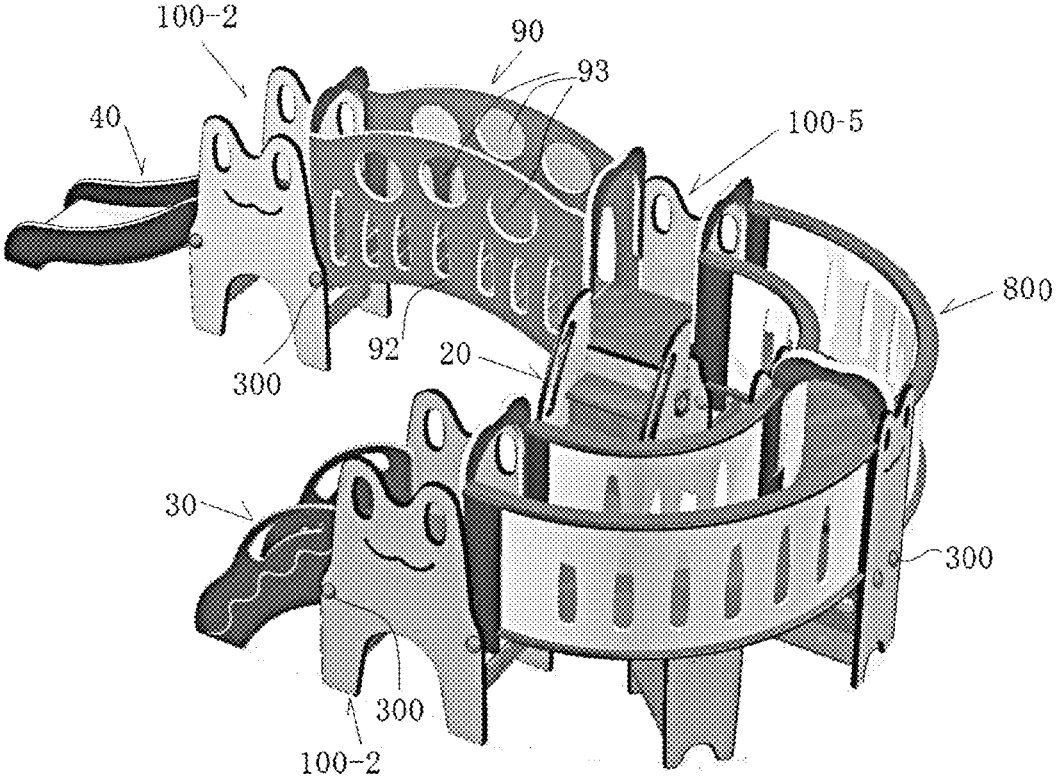
FIG. 22 gives a perspective explanatory view which shows an Example of Configuration 9.

Example of Configuration 8 which is shown in FIG. 21 is an example of configuration of a slide 40, a base 100-3, a wave bridge 130, a base 100-6, a step climbing stand 20, a ring tunnel 150, a base 100-6, and a climbing slope 120 in that order.

Example of Configuration 9

Example of Configuration 9 which is shown in FIG. 22 is a modification of the example which is shown in FIG. 17 and an example of configuration of a slide 40, a base 100-2, a bulging bridge 90, a base 100-5, a step climbing stand 20, a corridor bridge 800, a base 100-2, and a bulging climbing stand 30 in that order.

As shown by these introduced examples, it is possible to combine various pieces of equipment to match with the space in a playground area and possible to quickly and easily put together various playground facilities which are wonderful to see and are full of fun. Therefore, it is possible to obtain an excellent action and effect of enabling free creation of a paradise for the education and growth of imaginative young children with a challenging outlook on life.

INDUSTRIAL APPLICABILITY

The assembly play equipment for children of the present invention exhibits the above-mentioned excellent actions and effects, so is being broadly utilized in general homes of course and also kindergartens, daycare centers, and other child education facilities etc. and contributes tremendously to the education industry first and foremost and the furniture industry and playground equipment industry, playground equipment leasing industry, etc.

REFERENCE NOTATIONS LIST

KH-1: first connecting hole
KH-2: second connecting hole
KHR: rotation preventing part
ARK: anti-rotation part
100-1, 100-2, 100-3, 100-4, 100-5, 100-6: base
140-1, 140-2, 140-3: end plate
20: step climbing stand
30: bulging climbing stand
40: slide
50: twisted slope
60: arcade bridge
70: arch balustrade net bridge
80, 800: corridor bridge
90: bulging bridge
120: climbing slope
130: wave bridge
150: ring tunnel
300: connecting piece

The invention claimed is:

1. An assembly play equipment for children which is comprised of a plurality of bases, each base comprised of a pair of end plates which are made vertical in shape and face each other, are formed with open windows at top parts of facing surfaces of the pair of end plates, are connected at center parts by a seat surface member, are connected at bottom parts by reinforcing members, and are provided at the center parts at the pair of end plates with first connecting holes for connection use which form rotation preventing parts, wherein one of the plurality of bases at respective end plates is capable of having either one or two of the following (1) through (4) connected to the one of the plurality of bases by connecting pieces through second connecting holes of the following (1) through (4) and said first connecting holes:

(1) a step climbing stand which is provided at two sides of climbing steps with handrail-equipped holding frames and is provided at top end parts of the handrail-equipped holding frames with the second connecting holes for said connecting piece use and forming the rotation preventing parts;

(2) a bulging climbing stand which is provided at two sides of a bulging climbing plate with handrail-equipped holding frames, is provided at said bulging climbing plate with climbing assisting ropes, and is provided at top end parts of the handrail-equipped holding frames of the bulging climbing stand with the second connecting holes for said connecting piece use and forming the rotation preventing parts;

(3) a slide which is provided at two sides of a slide plate with handrail-equipped holding frames and is provided at the top end parts of the handrail-equipped holding frames of the slide with the second connecting holes for said connecting piece use and forming the rotation preventing parts;

(4) a twisted slope which is provided at two sides of a slide plate of the twisted slope with handrail-equipped holding frames, is provided at top end parts of the handrail-equipped holding frames of the twisted slope with the second connecting holes for said connecting piece use and forming the rotation preventing parts, and has a twisted slide surface member arranged at said slide plate of the twisted slope; and wherein between two of the plurality of bases at respective end plates, only one of the following (5) through (9) is capable of being connected to the two of the plurality of bases by the connecting pieces through second connecting holes of the following (5) through (9) and said first connecting holes:

(5) an arcade bridge which is provided at the two sides of a crossing member with handrail-equipped holding frames which are formed with open windows, has attached to it a transparent arcade which is configured to surround two sides and a top of a young child passing between the handrail-equipped holding frames, and is provided at two end parts respectively at a front and a back of the handrail-equipped holding frames of the arcade bridge with the second connecting holes for said connecting piece use and forming the rotation preventing parts;

(6) an arch balustrade net bridge which is provided at two sides of a net member with holding frames which are curved outward, has arch shaped balustrades comprised of horizontal members and vertical members assembled together attached to the holding frames, is provided at two end parts respectively at a front and a back of the holding frames with support members, and is provided at the support members with the second connecting holes for said connecting piece use and forming the rotation preventing parts;

(7) a corridor bridge which is provided at two sides of a curved crossing corridor bridge with holding side walls which are formed with open windows and is provided at two end parts respectively at a front and a back of the holding side walls with the second connecting holes for said connecting piece use and forming the rotation preventing parts;

(8) a wave bridge which is provided at two sides of a wave crossing plate with holding arch walls provided with first open windows and with second open windows over which transparent plates are attached preventing falls, is provided at an entrance and exit of the holding arch walls with support arches, and is provided at bottom end parts of the holding arch walls with the second connecting holes for said connecting piece use and forming the rotation preventing parts; and (9) a ring tunnel which is provided with a plurality of oval rings and a net which surround a bottom part, two side parts, and upper part of a curved crossing plate, arch members which support the bottom part, the two side parts, and the upper part of the curved crossing plate through horizontal bars and which are arranged at an entrance and an exit, and support members at a bottom part of the arch members, wherein at the support members, the second connecting holes for said connecting piece use and forming the rotation preventing parts being provided; and wherein each said connecting piece is provided with a bolt which is formed at a back part of the bolt with a flange which abuts against an entrance circumferential surface of one or a plurality of the first connecting holes or one or a plurality of the second connecting holes, is formed at the flange with an insert connecting part which forms a rotation preventable part which is fit into said rotation preventing part of said first connecting hole or second connecting hole, and is formed with a male screw part at a part which sticks out from said first connecting hole or second connecting hole and is provided with a nut which is formed with a flange of the nut which abuts against an exit circumferential surface of said first connecting hole or said second connecting hole through a looseness preventing packing and is formed with a female screw part which screws over the male screw part of said bolt.

* * * * *